US010614784B2

(12) United States Patent
Shurte

(10) Patent No.: US 10,614,784 B2
(45) Date of Patent: Apr. 7, 2020

(54) IN CASE MUSIC INSTRUMENT STAND

(71) Applicant: David S. Shurte, Dayton, OH (US)

(72) Inventor: David S. Shurte, Dayton, OH (US)

( * ) Notice: Subject to any disclaimer, the term of this patent is extended or adjusted under 35 U.S.C. 154(b) by 0 days.

(21) Appl. No.: 16/255,805

(22) Filed: Jan. 23, 2019

(65) Prior Publication Data

US 2019/0228751 A1 Jul. 25, 2019

Related U.S. Application Data

(60) Provisional application No. 62/620,629, filed on Jan. 23, 2018.

(51) Int. Cl.
*G10G 5/00* (2006.01)
*G10G 7/00* (2006.01)

(52) U.S. Cl.
CPC ..... *G10G 5/00* (2013.01); *G10G 7/005* (2013.01)

(58) Field of Classification Search
CPC ..... G10G 5/00
See application file for complete search history.

(56) References Cited

U.S. PATENT DOCUMENTS 1,986,703 A * 1/1935 Baker ..... G10G 5/00 206/14
2,884,828 A * 5/1959 Montenare ..... G10G 5/00 84/327
3,371,570 A * 3/1968 Lester ..... G10G 5/00 84/327
4,233,785 A 9/1980 Jacques
4,474,290 A 10/1984 DeMato
5,833,051 A 11/1998 Tiefenbrun
6,145,801 A 11/2000 Herring, Jr.
6,296,213 B1 10/2001 Law, III
6,462,260 B2 10/2002 Fediakov
6,951,280 B1 10/2005 Lee
6,959,810 B2 11/2005 Neilson
8,063,291 B2 * 11/2011 Crowder ..... G10G 7/005 206/314
8,362,345 B1 * 1/2013 Rice ..... G10G 5/00 248/443
2006/0032359 A1 2/2006 Smith
2010/0059397 A1 3/2010 Crowder
2015/0340020 A1 * 11/2015 Noska ..... G10G 5/00 84/327
2019/0189099 A1 * 6/2019 Bedore ..... G10G 7/005
2019/0228751 A1 * 7/2019 Shurte ..... G10G 5/00
2019/0287500 A1 * 9/2019 Lavineway ..... G10G 5/00

* cited by examiner

*Primary Examiner* — Robert W Horn

(74) *Attorney, Agent, or Firm* — Stephen T. Murphy Law LLC; Stephen T. Murphy; Peter D. Meyer

(57) ABSTRACT

An in-case stand for a musical instrument that supports a musical instrument in the open musical instrument case, such as a guitar, in an inclined position making the headstock and the neck readily accessible for string changes, cleaning or light maintenance.

3 Claims, 18 Drawing Sheets

Cut Away Side Veiw

Cut Away Side Veiw

Cut Away Side Veiw

IN CASE MUSIC INSTRUMENT STAND

FIELD OF THE INVENTION

The present disclosure relates to a case for storing and transporting string musical instruments, guitars in particular which also comprises a built in support to support the instrument in an inclined position. While this disclosure discusses an embodiment of such a case for use with a guitar, such as an acoustical, electrical, or standard guitar, other embodiments exists for use with other string instruments such as banjos, violins, cellos, double bass, etc. Specifically, this invention relates to an in-case stand for the musical instrument that provides support in an inclined position making the headstock and the neck readily accessible for string changes, cleaning or light maintenance.

BACKGROUND OF THE INVENTION

Many musicians take great care of their instruments so they continue to play and sound great. One such method of care is the use of a protective carrying case. Such instrument cases are quite common. And while they protect the instrument during storage and transport, they fail to offer protection while the instrument is undergoing string changes, cleaning or other light maintenance. Often musicians will hold their instrument on their lap or on a countertop to perform such light maintenance, however, the instrument is more likely to get damaged as it is not sufficiently supported.

Some attempts in the prior art have been made to modify an instrument case to allow for the special handling of the instrument to securely position the instrument for light maintenance. Smith, U.S. Pat. App. Pub. 2006/0032359A1, for example, shows an instrument case with a removable plate to hang a guitar from the top of the case. Smith, however, fails to securely position the guitar as it is free to swing and potentially fall. Additionally, Smith provides for a removable plate that is not integral to the case for easy use and storage of the holder itself.

In another prior art example, Crowder et al, U.S. Pat. App. Pub. 2010/0059397A1 shows an instrument case having an exterior foldable stand that suspends the guitar. Crowder, however, fails to securely position the guitar as it is free to swing and potentially fall. Additionally, Crowder positions the guitar exterior to the case which does not sufficient protect the case. Further, the exterior positioning of the guitar makes the stand less stable and more likely to fall over itself. In a similar fashion, DeMato, U.S. Pat. No. 4,474,290 and Tiefenbrun et al, U.S. Pat. No. 5,833,051 both require a removable holder to hold the guitar exterior to the case which provides for an inconvenient and less stable method for holding the guitar or instrument.

In another prior art example, Lee, U.S. Pat. No. 6,951,280B1 shows an instrument case that is adapted to be positioned vertically with its cover serving as a leg stand. And while this method provides easy access to the stored guitar, the case stands too high and does not provide a sufficient base to keep the center of gravity lower and thus more stable. Similar vertical-design approaches and shortcomings are used by Herring, Jr., U.S. Pat. No. 6,145,801, Neilson, U.S. Pat. No. 6,959,810 B2, Jacques, U.S. Pat. No. 4,223,785, and Fediakov, U.S. Pat. No. 6,462,260B2.

In another prior art example, Law, III et al, U.S. Pat. No. 6,296,213B1 shows an instrument case for the storage of multiple instruments. Law, however, fails to securely position the instrument in a face-forward orientation so as to permit the easy maintenance of the instrument.

What is needed is an instrument case that allows for the storage of an instrument and the secured positioning of the instrument for string changes, cleaning or other light maintenance.

What is needed is an instrument case that allows for the storage of a guitar and the secured positioning of the guitar for string changes, cleaning or other light maintenance.

What is needed is an instrument case that allows for the storage of a guitar and the secured positioning of the guitar for string changes, cleaning or other light maintenance, wherein the guitar is substantially stored within its case perimeter.

What is needed is an instrument case that allows for the storage of a guitar and the secured positioning of the guitar for string changes, cleaning or other light maintenance, wherein the guitar is substantially stored within its case perimeter and the instrument case is positioned substantially horizontal so as to provide a stable base for the storage of the guitar while undergoing maintenance.

SUMMARY OF THE INVENTION

This disclosure relates to an in-case stand for a musical instrument that supports a musical instrument in the open musical instrument case, such as a guitar, in an inclined position making the headstock and the neck readily accessible for string changes, cleaning or light maintenance. The in-case stand may consist of a formed support with a coating to protect the instrument surfaces. The in-case stand in the upright position may support the musical instrument at the base of the neck and the musical instrument headstock. When the in-case stand is in the storage configuration, the in-case stand may lay substantially flat in low-profile beneath the musical instrument headstock within the musical instrument case.

The in-case stand for holding a musical instrument within an instrument case has an adjustable support having sufficient rigidity for holding and inclining a musical instrument, the adjustable support comprising a cradle portion being adapted to receive the top portion of an instrument, a body portion being of sufficient length and rigidity to permit the proper angle and height of the instrument when in-case is in the upright position and a base portion being adapted to engage and attach said in-case stand to the inside of the instrument case.

The in-case stand may be adapted to be repositioned between a lay-down position for storage of an instrument and an incline-position for upright holding of an instrument. The in-case stand may be adapted to be placed in a flat position in the musical instrument case below the headstock of the musical instrument. The in-case stand may be adapted to be placed in an upright position in the open musical instrument case below the headstock of the musical instrument to cradle and support the base of the neck and the headstock of the musical instrument.

The in-case stand may have a base portion that is permanently attached to the inside of the instrument case. Alternatively, the base portion may be releasably attached to the inside of the instrument case.

The in-case stand may be adapted to store and upright-position for maintenance a variety of instruments including, but not limited to, an acoustic guitar, acoustic bass guitar, electric guitar, electric bass guitar, banjo, mandolin, viola, bass, violin and similar string musical instruments that are stored, transported and protected in a musical instrument case.

The adjustable support may be formed from a variety of materials including, but not limited to, wire rod, poly-laminate, acrylic sheet, wood, wood composites, plastics, metal, cardboard with flocked material and similar materials suitable for holding the headstock of a musical instrument. The cradle portion may be encapsulated in a damping material. The damping material may comprise rubber, vinyl, plastic, felt material or the like.

The in-case stand may have a permanent material-hinge so as to allow said in-case stand to be moved between a lay-down position for storage of the instrument and an upright position for the upright incline of an instrument during maintenance.

The in-case stand may have a circular rod base so as to allow in-case stand to be moved between a lay-down position for storage of the instrument and an upright position for the upright incline of an instrument during maintenance.

The in-case stand may have a rubber-rounded-post to accommodate the releasable attachment of said in-case stand to the inside of an instrument case. The base portion may be adapted for a wider instrument case intended for a larger-sized instrument.

The in-case stand may have a permanent hinge to accommodate the permanent attachment of said in-case stand to the inside of an instrument case.

The in-case stand may have a relief cut-out to reduce the amount of material and weight of adjustable support to ultimately reduce the weight of the instrument case making it easier for the musician to carry it.

The in-case stand and instrument case together may be adapted to hold a musical instrument on both its neck and base respectively. The in-case stand and instrument case together may be adapted to hold a musical instrument substantially within the perimeter of the instrument case.

An in-case stand for holding a musical instrument within an instrument case having an adjustable support having sufficient rigidity for holding and inclining a musical instrument, the adjustable support comprising a cradle portion being adapted to receive the top portion of an instrument, a body portion being of sufficient length and rigidity to permit the proper angle and height of the instrument when in-case is in the upright position and a base portion being adapted to engage and attach said in-case stand to the inside of the instrument case. The in-case stand may be adapted to be repositioned between a lay-down position for storage of an instrument and an incline-position for upright holding of an instrument. The in-case stand may be adapted to be placed in a flat position in the musical instrument case below the headstock of the musical instrument.

An instrument case having an in-case stand for holding a musical instrument. The in-case stand comprising an adjustable support having sufficient rigidity for holding and inclining a musical instrument. The adjustable support comprising a cradle portion being adapted to receive the top portion of an instrument, a body portion being of sufficient length and rigidity to permit the proper angle and height of the instrument when in-case is in the upright position and a base portion being adapted to engage and attach said in-case stand to the inside of the instrument case. The in-case stand and instrument case together may be adapted to hold a musical instrument on both its neck and base respectively. The in-case stand and instrument case together may be adapted to hold a musical instrument substantially within the perimeter of the instrument case.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. None of the drawings are necessarily to scale. These drawings are meant to be exemplary and not meant to be limiting of the present invention.

DETAILED DESCRIPTION OF THE INVENTION

Figure 1A:
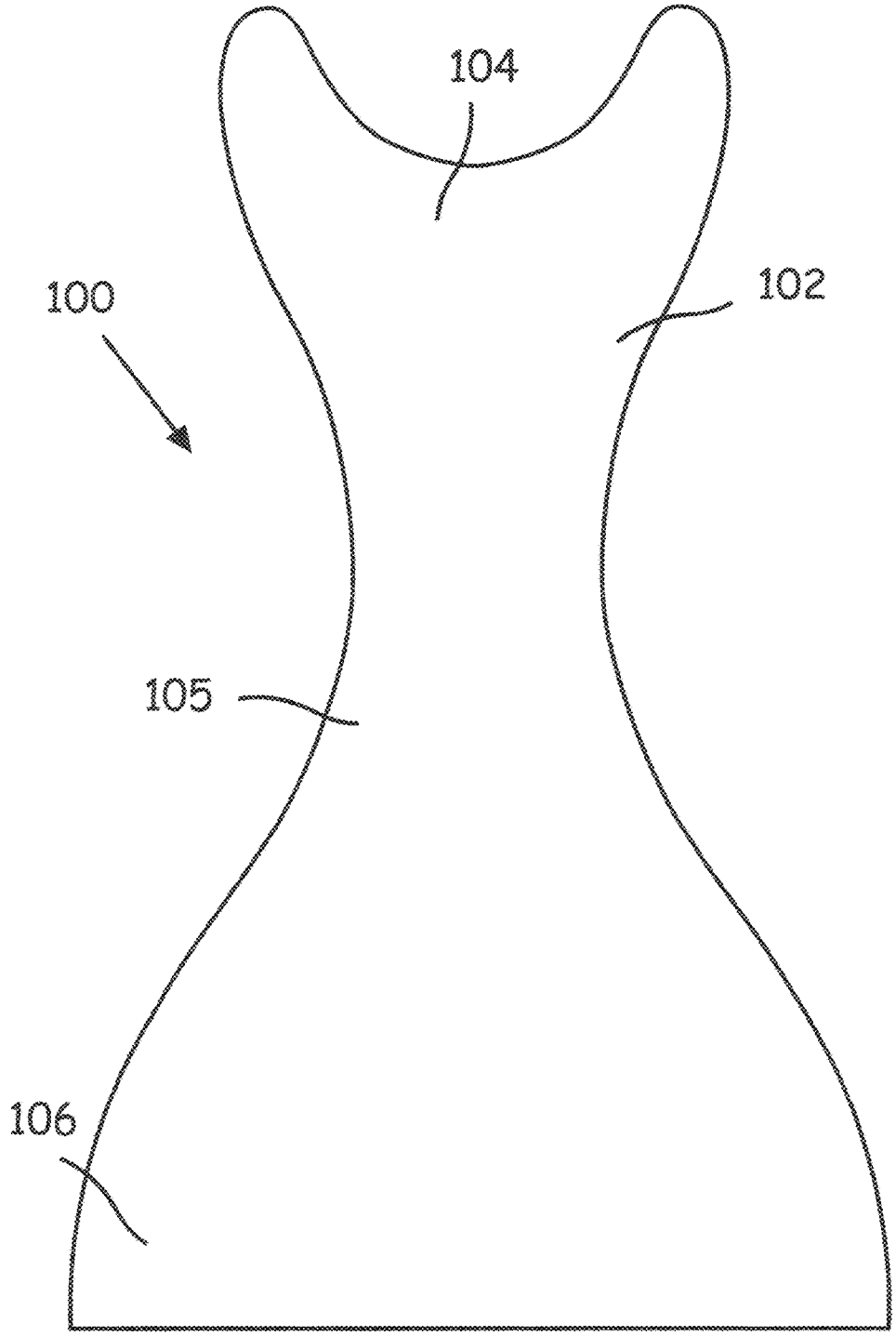
FIGS. 1A and 1B are front and side views, respectively, of an in-case stand in a basic configuration in accordance with an exemplary embodiment of the present invention.
Figure 1B:
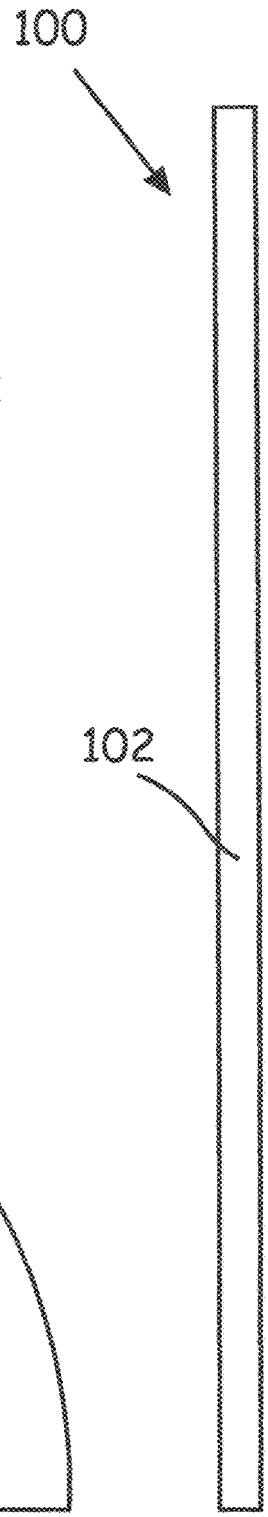

FIGS. 1A and 1B are front and side views, respectively, of an in-case stand 100 in a basic configuration in accordance with an exemplary embodiment of the present invention. The in-case stand 100 has an adjustable support 102 comprising a cradle portion 104, a body portion 105 and a base portion 106. Cradle portion 104 is adapted to receive the top portion of an instrument, like the neck of a guitar. Body portion 105 is of sufficient length and rigidity to permit the proper angle and height of the instrument when in-case 100 is in the upright position. Base portion 106 directly or indirectly attaches, permanently or releasably, to the inside of the instrument case.

Figure 2A:
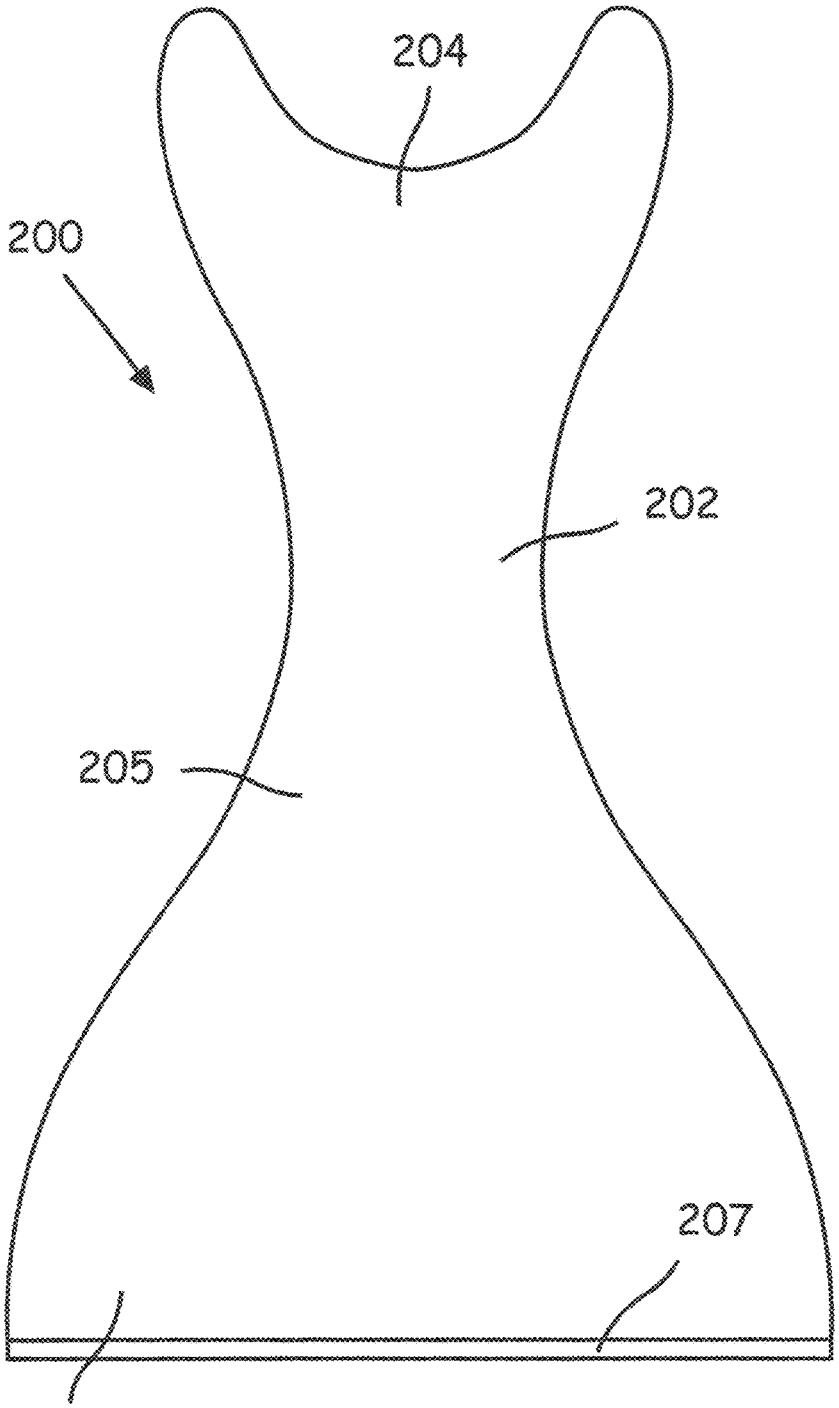
FIGS. 2A and 2B are front and side views, respectively, of an in-case stand in a permanent material hinge configuration in accordance with another exemplary embodiment of the present invention.
Figure 2B:
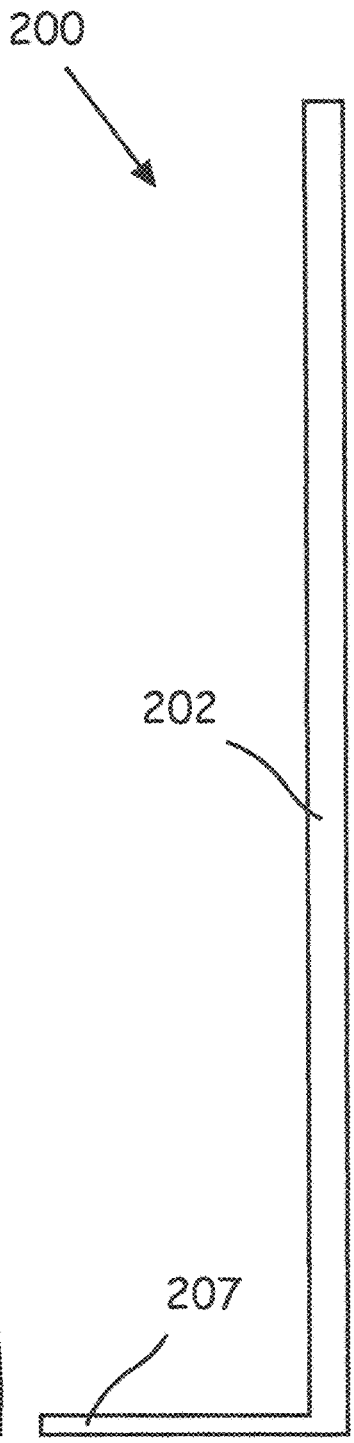

FIGS. 2A and 2B are front and side views, respectively, of an in-case stand 200 in a permanent material hinge configuration in accordance with another exemplary embodiment of the present invention. The in-case stand 200 has an adjustable support 202 comprising a cradle portion 204, a body portion 205 and a base portion 206. Cradle portion 204 is adapted to receive the top portion of an instrument, like the neck of a guitar. Body portion 205 is of sufficient length and rigidity to permit the proper angle and height of the instrument when in-case 200 is in the upright position. In-case stand 200 also has a permanent material-hinge 207 connected to the base portion 206 so as to allow in-case stand 200 to be moved between a lay-down position, for storage of the instrument, and an upright position, for the upright incline of an instrument during maintenance.

Figure 3A:
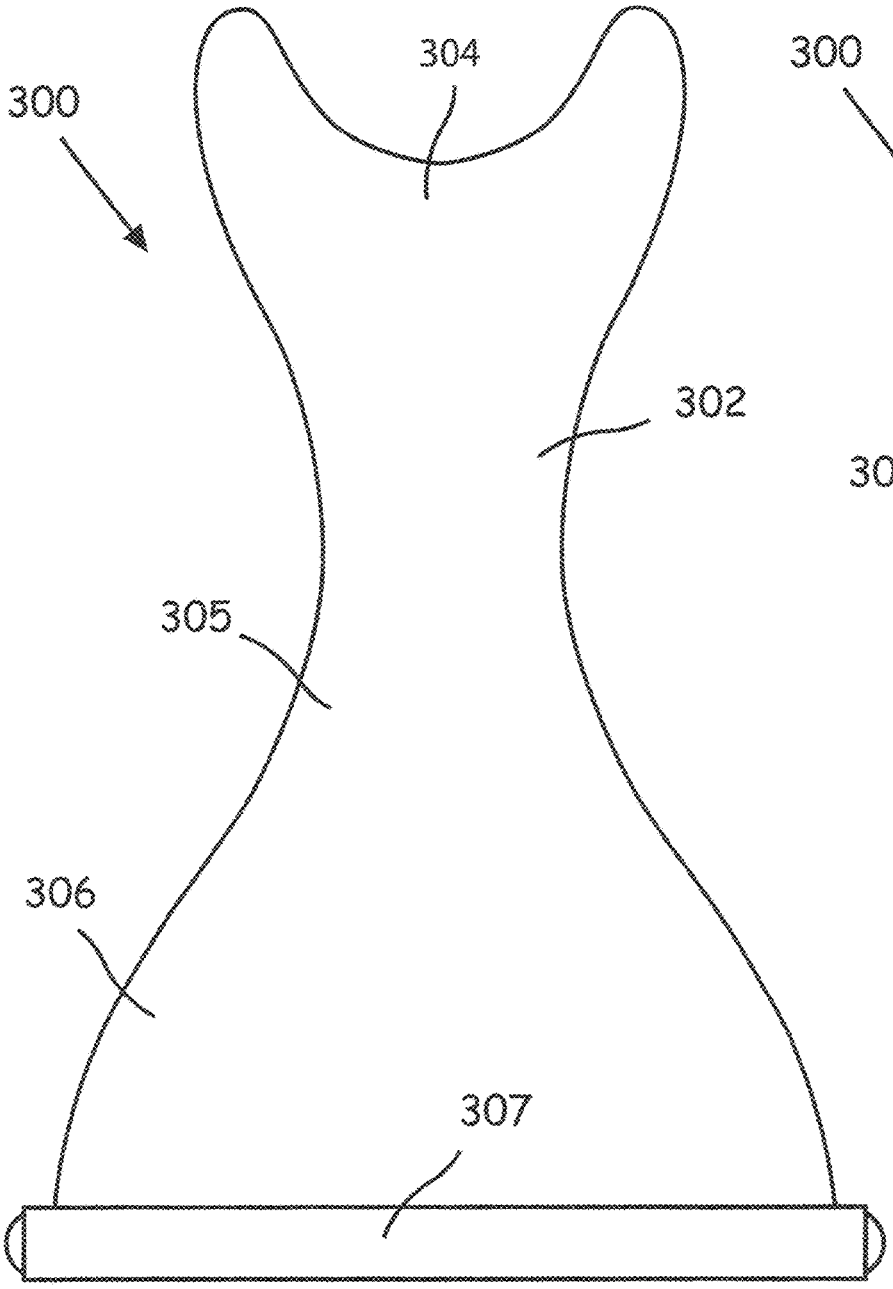
FIGS. 3A and 3B are front and side views, respectively, of an in-case stand in a circular rod base configuration in accordance with another exemplary embodiment of the present invention.
Figure 3B:
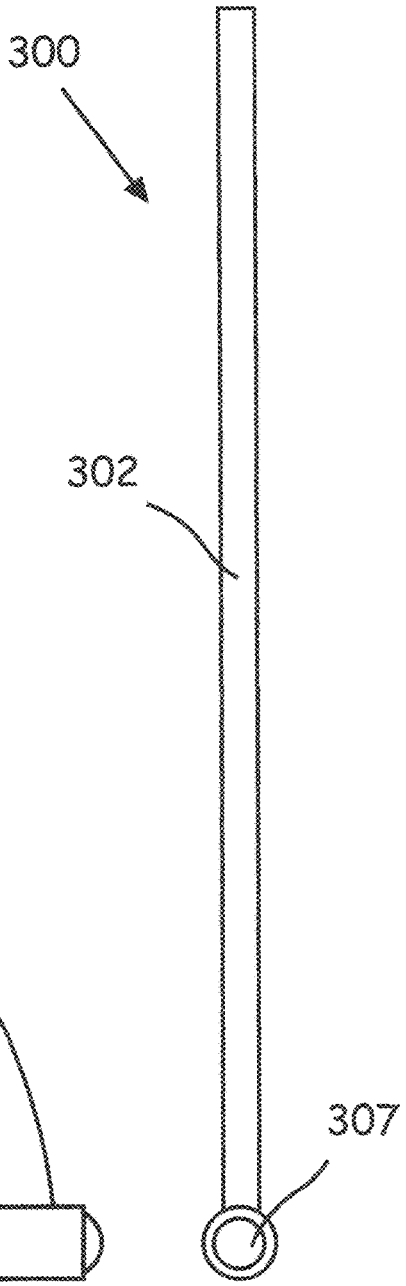

FIGS. 3A and 3B are front and side views, respectively, of an in-case stand 300 in a circular rod base configuration in accordance with another exemplary embodiment of the present invention. The in-case stand 300 has an adjustable support 302 comprising a cradle portion 304, a body portion 305 and a base portion 306. Cradle portion 304 is adapted to receive the top portion of an instrument, like the neck of a guitar. Body portion 305 is of sufficient length and rigidity to permit the proper angle and height of the instrument when in-case 300 is in the upright position. In-case stand 300 also having a circular rod base 307 connected to the base portion 306 so as to allow in-case stand 300 to be moved between a lay-down position (for storage of the instrument) and an upright position (for the upright incline of an instrument during maintenance).

Figure 4A:
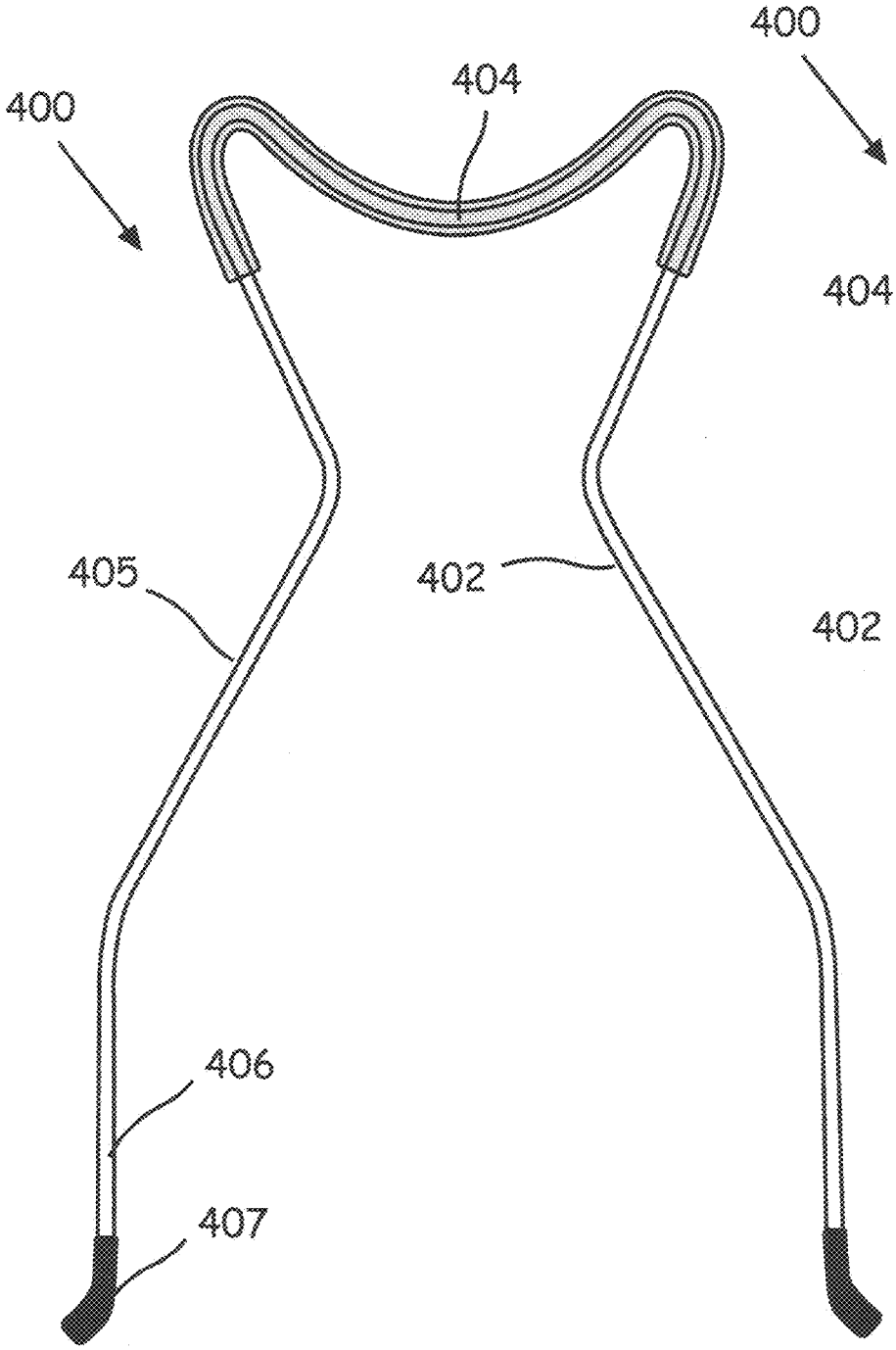
FIGS. 4A and 4B are front and side views, respectively, of an in-case stand in a wire rod frame configuration in accordance with another exemplary embodiment of the present invention.
Figure 4B:
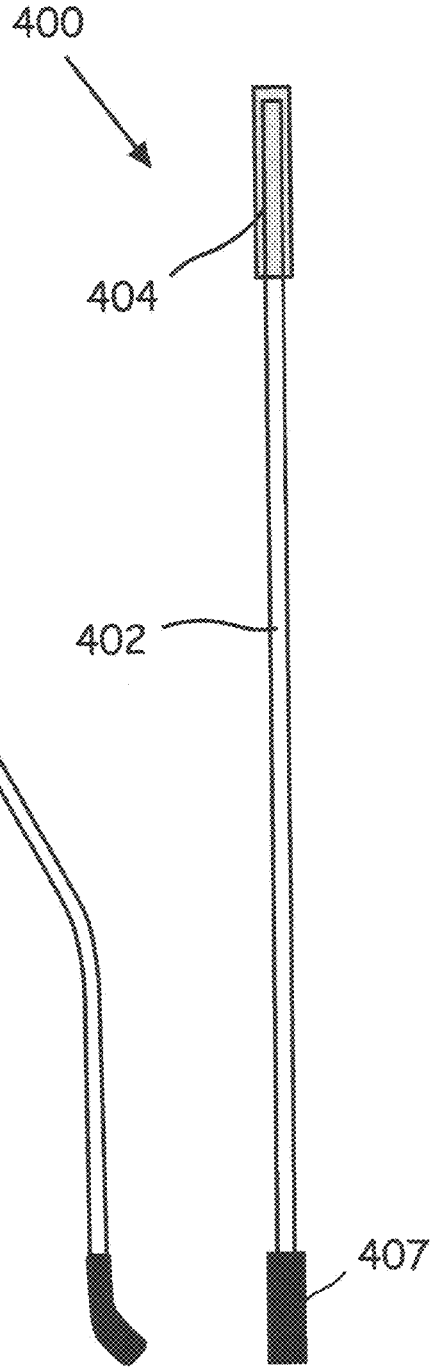

FIGS. 4A and 4B are front and side views, respectively, of an in-case stand 400 in a wire rod frame configuration in accordance with another exemplary embodiment of the present invention. The in-case stand 400 has a wire-frame 402 comprising a cradle portion 404, a body portion 405 and a base portion 406. Cradle portion 404 is adapted to receive the top portion of an instrument, like the neck of a guitar. Body portion 405 is of sufficient length and rigidity to permit the proper angle and height of the instrument when in-case 400 is in the upright position. In-case stand 400 also having a rubber-rounded-post 407 connected to the base portion 406 to accommodate the releasable attachment of in-case stand 400 to the inside of an instrument case. In-case stand 400 is adapted to be moved between a lay-down position, for storage of the instrument, and an upright position, for the upright incline of an instrument during maintenance.

Figure 5B:
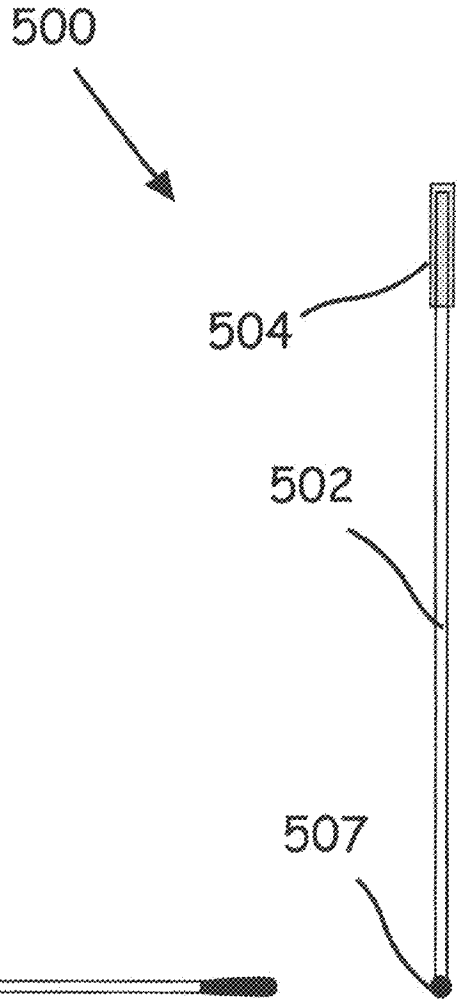
FIGS. 5A and 5B are front and side views, respectively, of an in-case stand in a wire rod frame for a large musical instrument case configuration in accordance with another exemplary embodiment of the present invention.
Figure 5A:
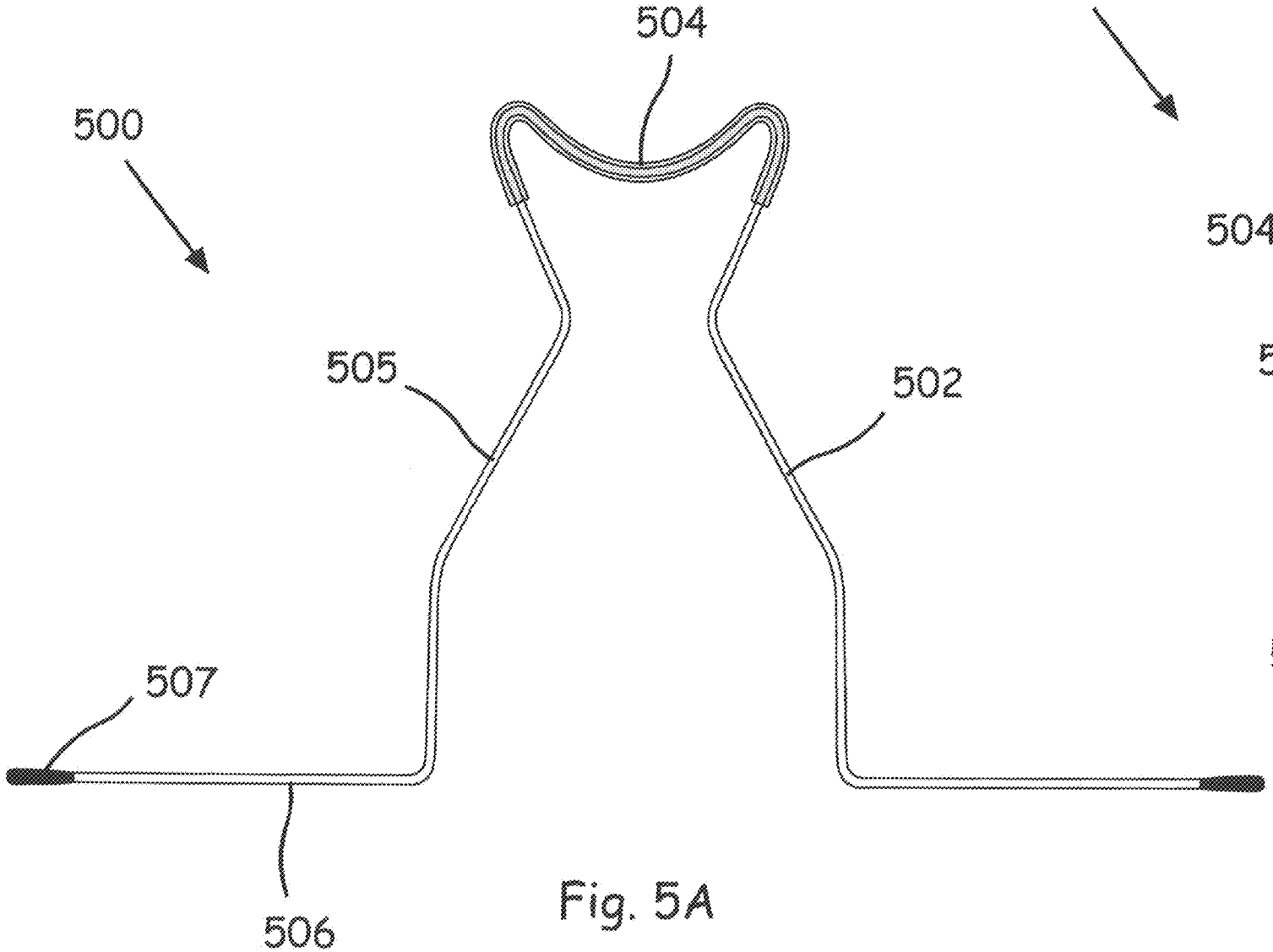

FIGS. 5A and 5B are front and side views, respectively, of an in-case stand 500 in a wire rod frame for a large musical instrument case configuration in accordance with another exemplary embodiment of the present invention. The in-case stand 500 has a wire-frame 502 comprising a cradle portion 504, a body portion 505 and a base portion 506. Cradle portion 504 is adapted to receive the top portion of an instrument, like the neck of a guitar. Body portion 505 is of sufficient length and rigidity to permit the proper angle and height of the instrument when in-case 500 is in the upright position. In-case stand 500 also has a rubber-rounded-post 507 connected to the base portion 506 to accommodate the releasable attachment of in-case stand 500 to the inside of an instrument case. In-case stand 500 is adapted to be moved between a lay-down position, for storage of the instrument, and an upright position, for the upright incline of an instrument during maintenance.

Figure 6A:
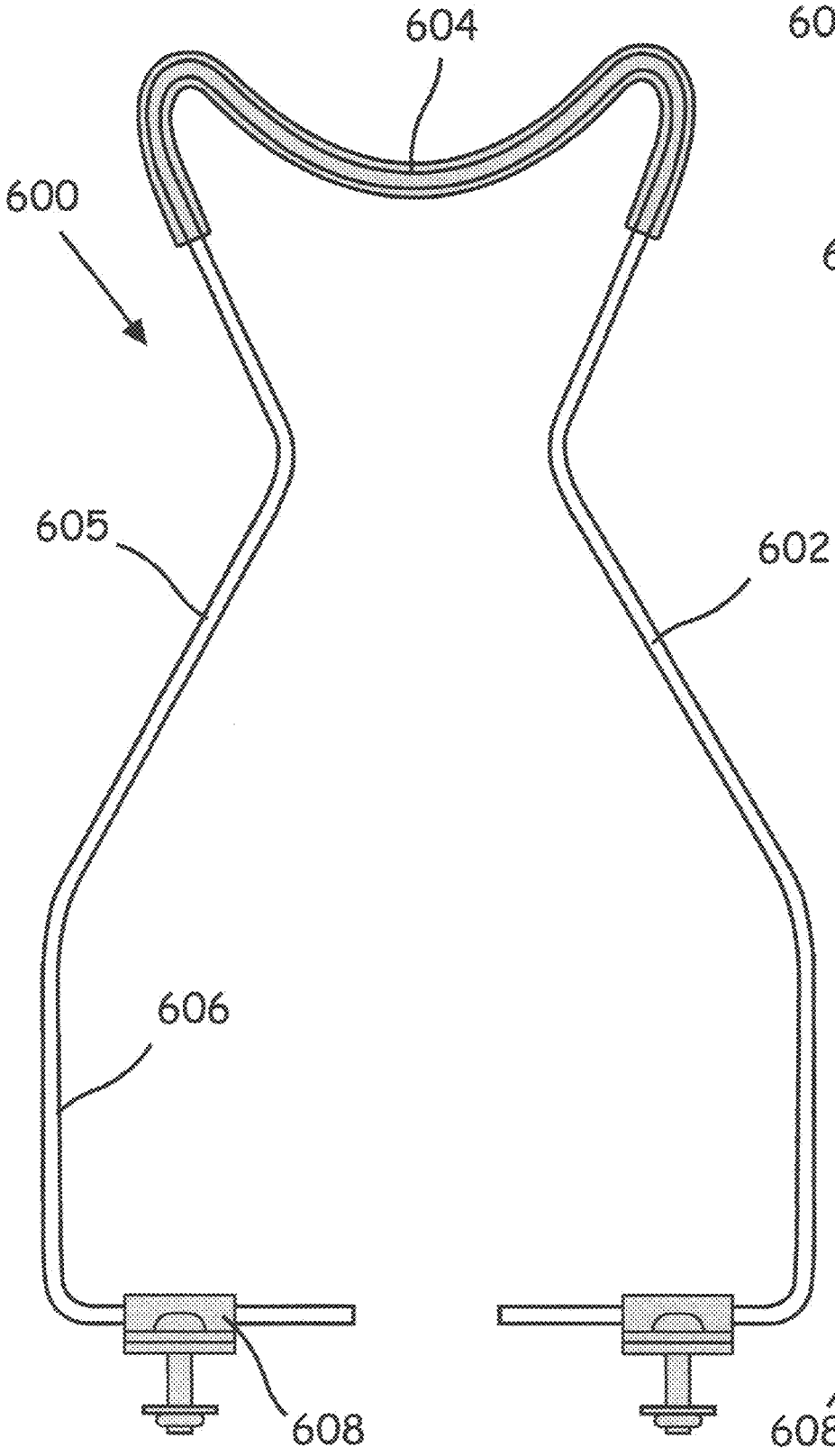
FIGS. 6A and 6B are front and side views, respectively, of an in-case stand in a wire rod frame with a permanent hinge configuration in accordance with another exemplary embodiment of the present invention.
Figure 6B:
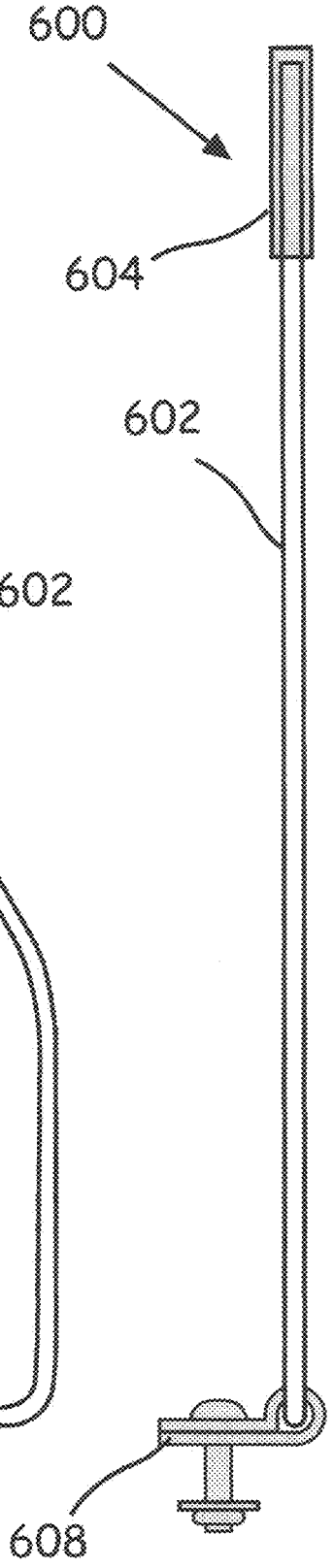

FIGS. 6A and 6B are front and side views, respectively, of an in-case stand in a wire rod frame with a permanent hinge configuration in accordance with another exemplary embodiment of the present invention. The in-case stand 600 has a wire-frame 602 comprising a cradle portion 604, a body portion 605 and a base portion 606. Cradle portion 604 is adapted to receive the top portion of an instrument, like the neck of a guitar. Body portion 605 is of sufficient length and rigidity to permit the proper angle and height of the instrument when in-case 600 is in the upright position. In-case stand 600 also has a permanent hinge 608 connected to the base portion 606 to accommodate the permanent attachment of in-case stand 600 to the inside of an instrument case. In-case stand 600 is adapted to be moved between a lay-down position, for storage of the instrument, and an upright position, for the upright incline of an instrument during maintenance.

Figure 7A:
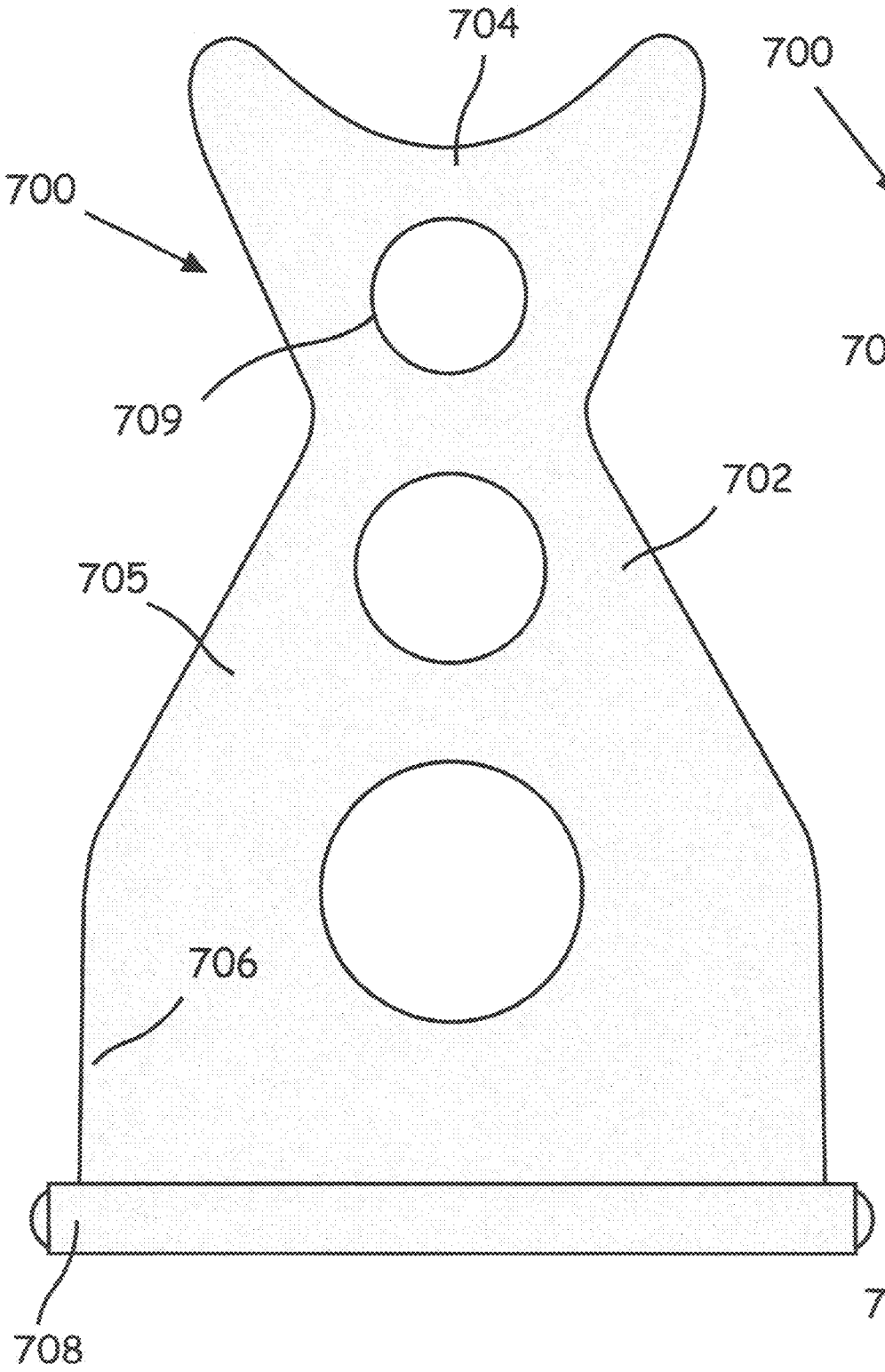
FIGS. 7A and 7B are front and side views, respectively, of an in-case stand having a circular rod base and having a relief cut-out configuration in accordance with another exemplary embodiment of the present invention.
Figure 7B:
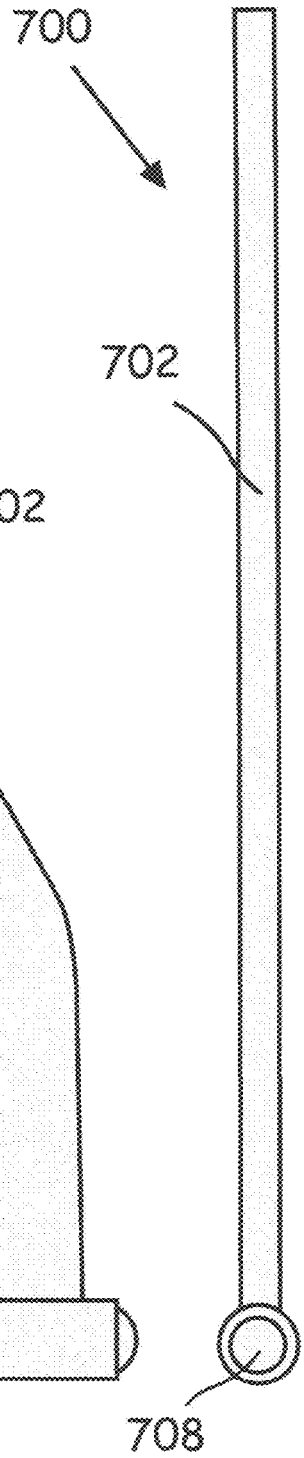

FIGS. 7A and 7B are front and side views, respectively, of an in-case stand 700 having a circular rod base and having a relief cut-out configuration in accordance with another exemplary embodiment of the present invention. The in-case stand 700 has an adjustable support 702 comprising a cradle portion 704, a body portion 705 and a base portion 706. Cradle portion 704 is adapted to receive the top portion of an instrument, like the neck of a guitar. Body portion 705 is of sufficient length and rigidity to permit the proper angle and height of the instrument when in-case 700 is in the upright position. In-case stand 700 also has a circular rod base 708 connected to the base portion 706 to accommodate the permanent attachment of in-case stand 700 to the inside of an instrument case. In-case stand 700 is adapted to be moved between a lay-down position, for storage of the instrument, and an upright position, for the upright incline of an instrument during maintenance. In-case stand 700 also has one or more relief cut-outs 709 to reduce the amount of material and weight of adjustable support 702 to ultimately reduce the weight of the instrument case making it easier for the musician to carry it.

Figure 8B:
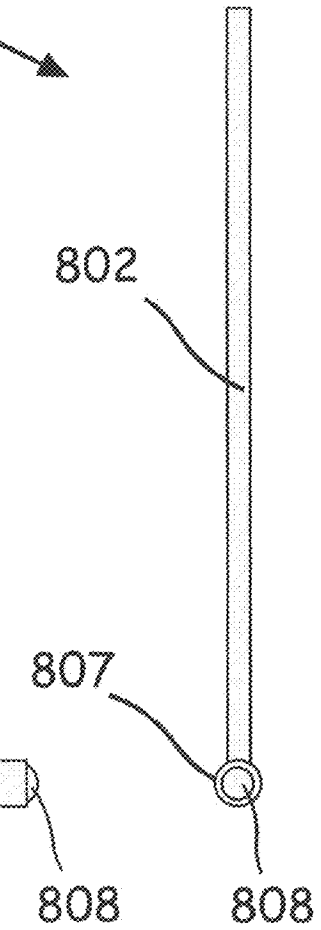
FIGS. 8A and 8B are front and side views, respectively, of an in-case stand for a musical instrument, wherein the in-case stand having a circular rod base and having a relief cut-out configuration in accordance with another exemplary embodiment of the present invention.
Figure 8A:
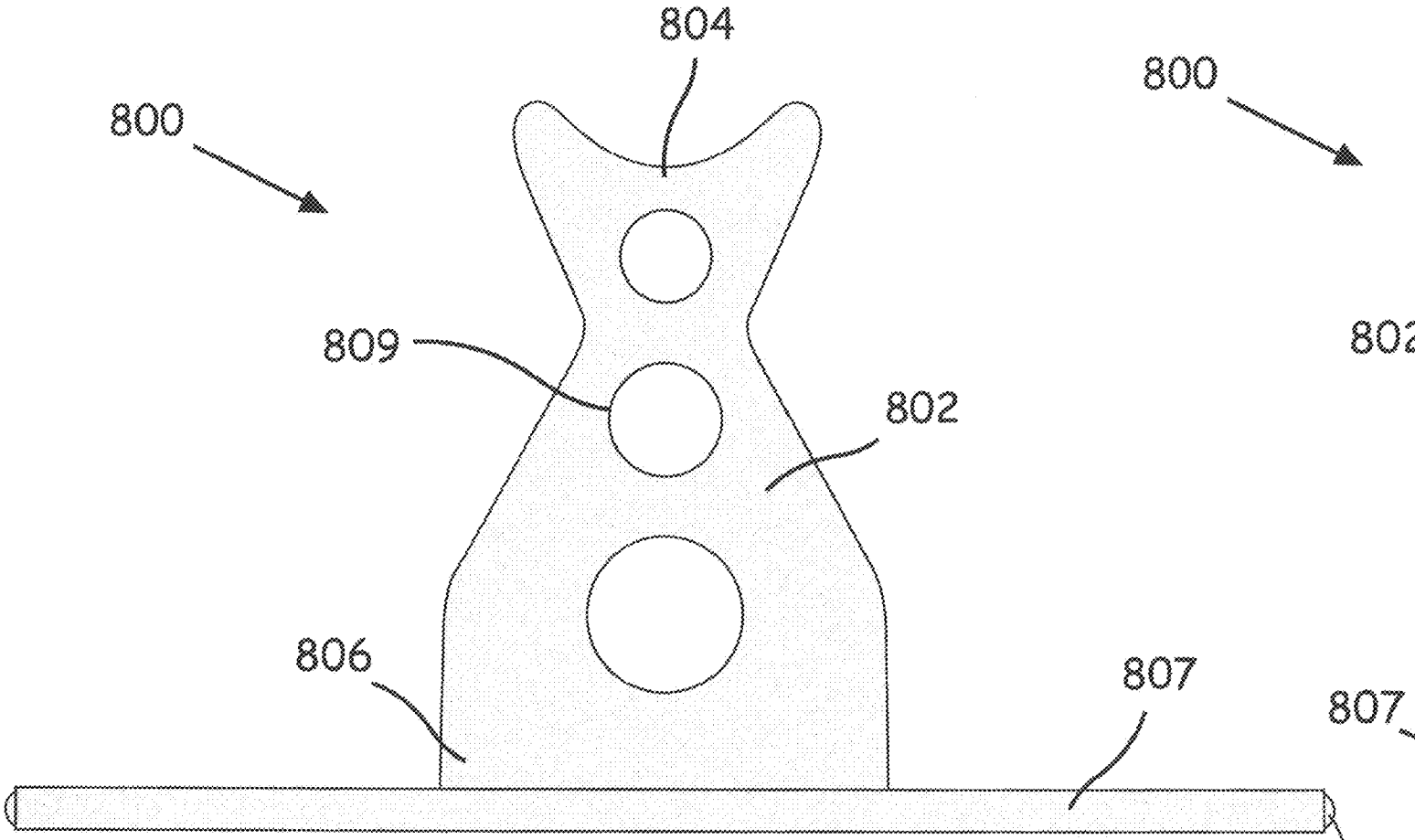

FIGS. 8A and 8B are front and side views, respectively, of an in-case stand 800 for a musical instrument, wherein the in-case stand has a circular rod base and has a relief cut-out configuration in accordance with another exemplary embodiment of the present invention. In-case stand 800 has an adjustable support 802 comprising a cradle portion 804, a body portion 805 and a base portion 806. Cradle portion 804 is adapted to receive the top portion of an instrument, like the neck of a guitar. Body portion 805 is of sufficient length and rigidity to permit the proper angle and height of the instrument when in-case 800 is in the upright position. In-case stand 800 also having a circular rod base 808 connected to the base portion 806 to accommodate the permanent attachment of in-case stand 800 to the inside of an instrument case. In-case stand 800 is adapted to be moved between a lay-down position, for storage of the instrument, and an upright position, for the upright incline of an instrument during maintenance. In-case stand 800 also has one or more relief cut-outs 809 to reduce the amount of material and weight of adjustable support 802 to ultimately reduce the weight of the instrument case making it easier for the musician to carry it.

Figure 9:
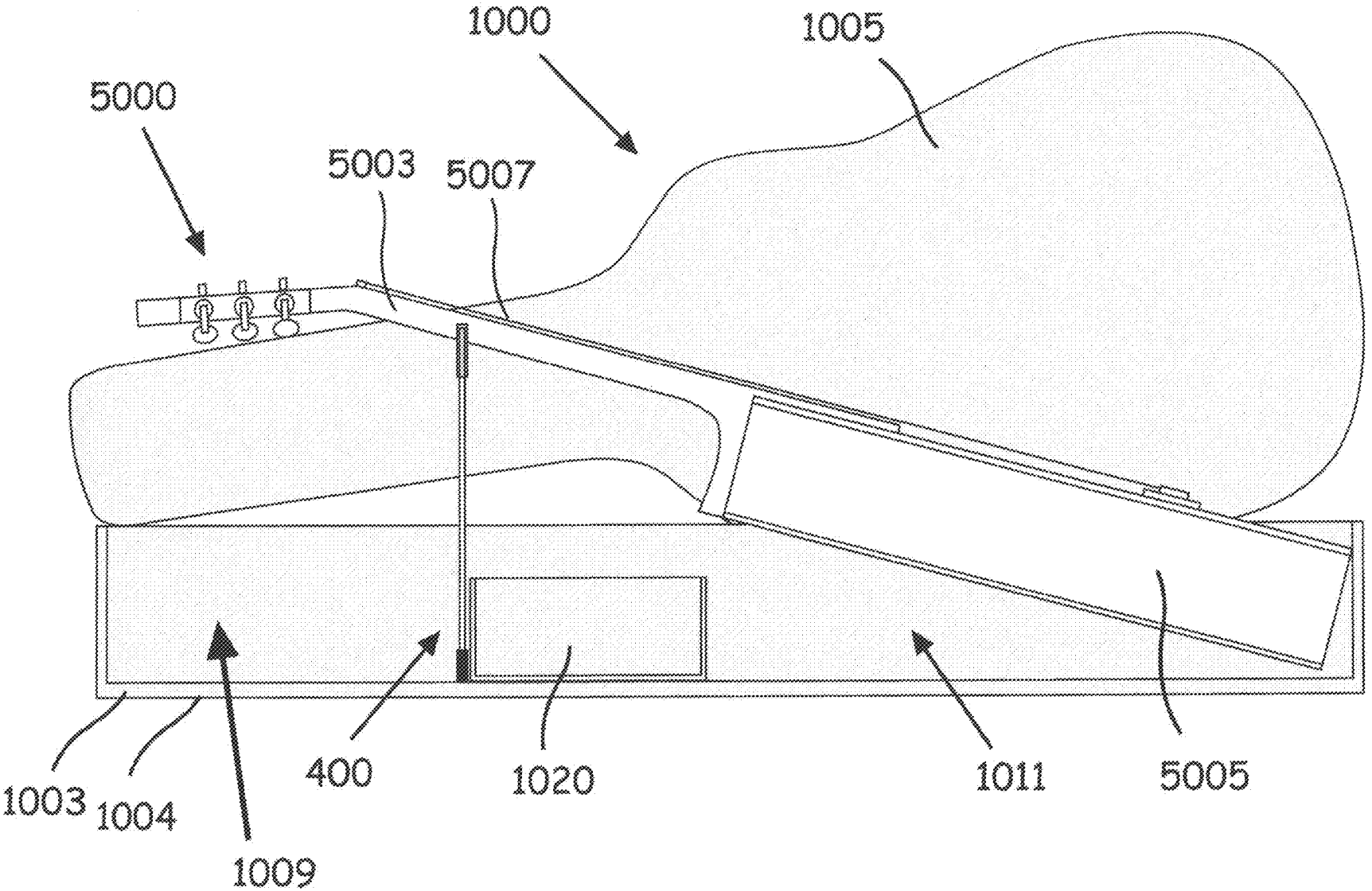
FIG. 9 is a cut-away, side view of an instrument case being opened and having an in-case stand being in the upright position supporting a musical instrument.

FIG. 9 is a cut-away, side view of an instrument case 1000 being opened and having an in-case stand 400 being in the upright position supporting a musical instrument 5000. Instrument case 1000 having a lid 1005 and a storage compartment 1003. The instrument case having a bottom surface 1004 for placement on the floor or other flat surfaces. Instrument case 1000 has a neck-storage area 1009 and a base-storage area 1011 with an accessory-storage bin 1020 positioned in-between. Musical instrument 5000 here depicted as a guitar having a guitar neck-portion 5003, guitar base-portion 5005 and musical strings 5007.

Figure 10:
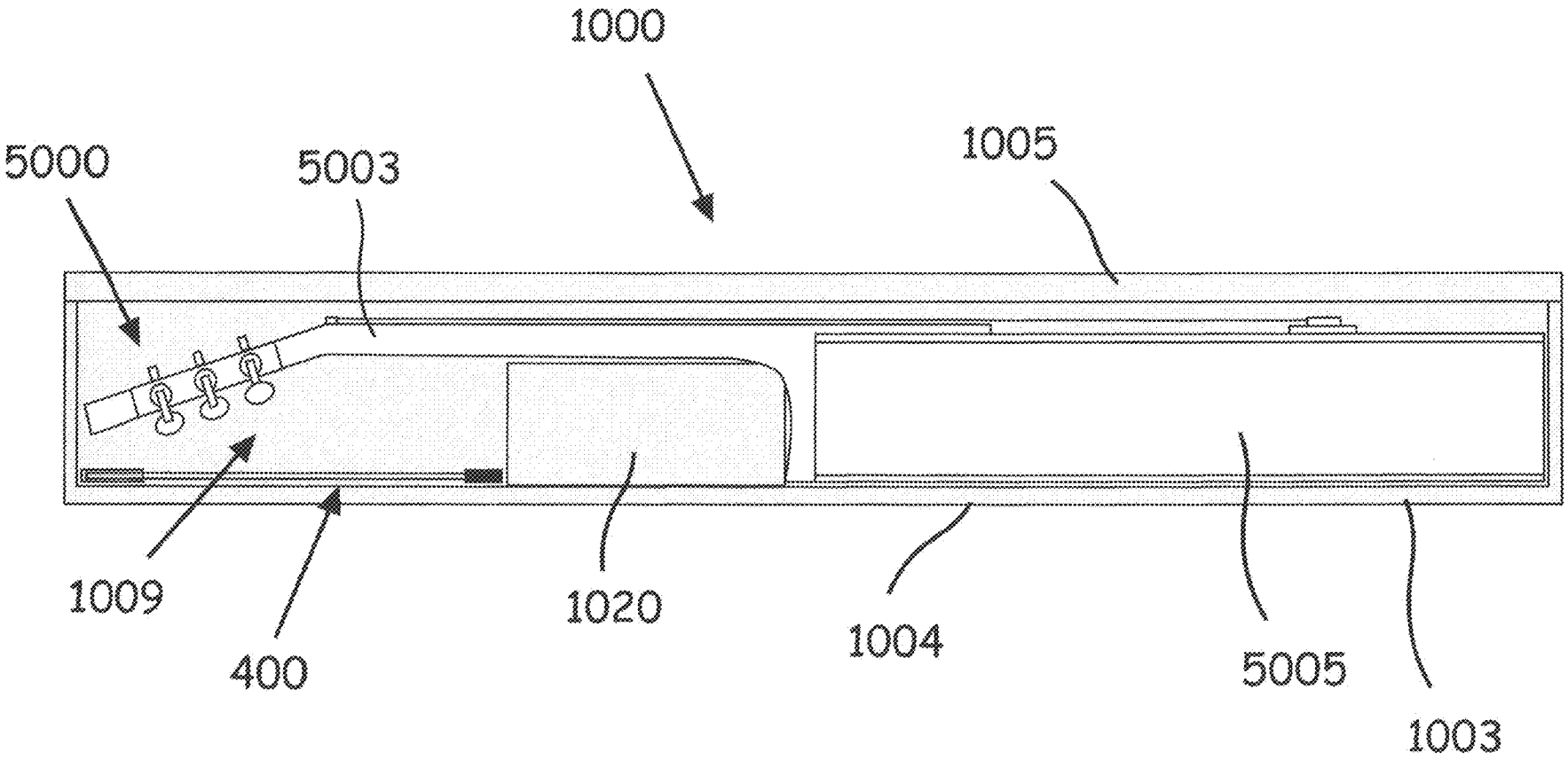
FIG. 10 is a cut-away, side view of the instrument case of FIG. 9 being closed and having an in-case stand being in the lay-down position underneath a musical instrument.

FIG. 10 is a cut-away, side view of instrument case 1000 of FIG. 9 being closed and having an in-case stand 400 being in the lay-down position underneath musical instrument 5000. In this view, it can be appreciated the simplicity and ease of how in-case stand 400 can be moved to the lay-down position for quick storage of musical instrument 5000.

Figure 11:
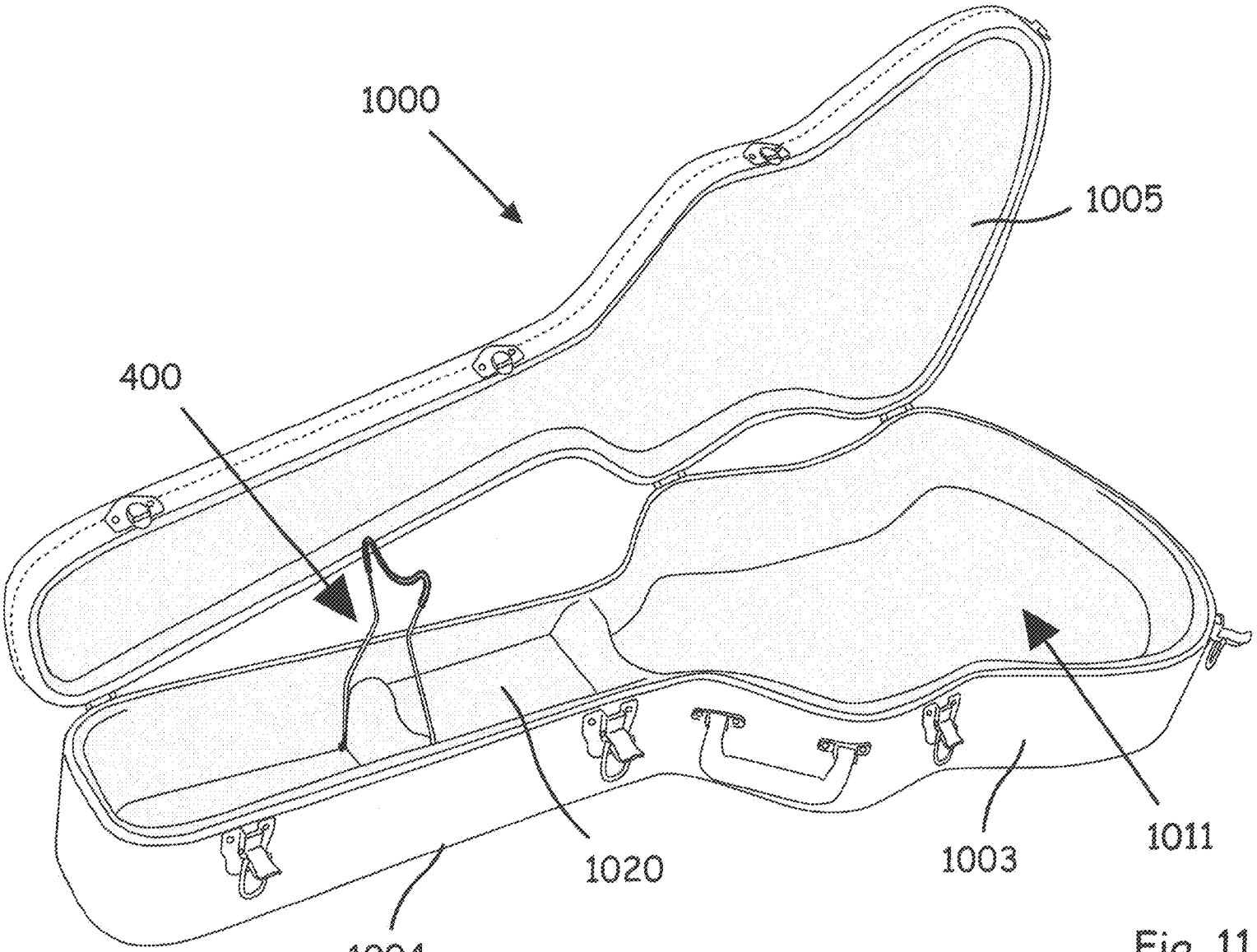
FIG. 11 is a perspective view of an instrument case of FIG. 10 being opened and having an in-case stand in the upright position.

FIG. 11 is a perspective view of instrument case 1000 of FIG. 10 being opened and having an in-case stand 400 in the upright position.

Figure 12:
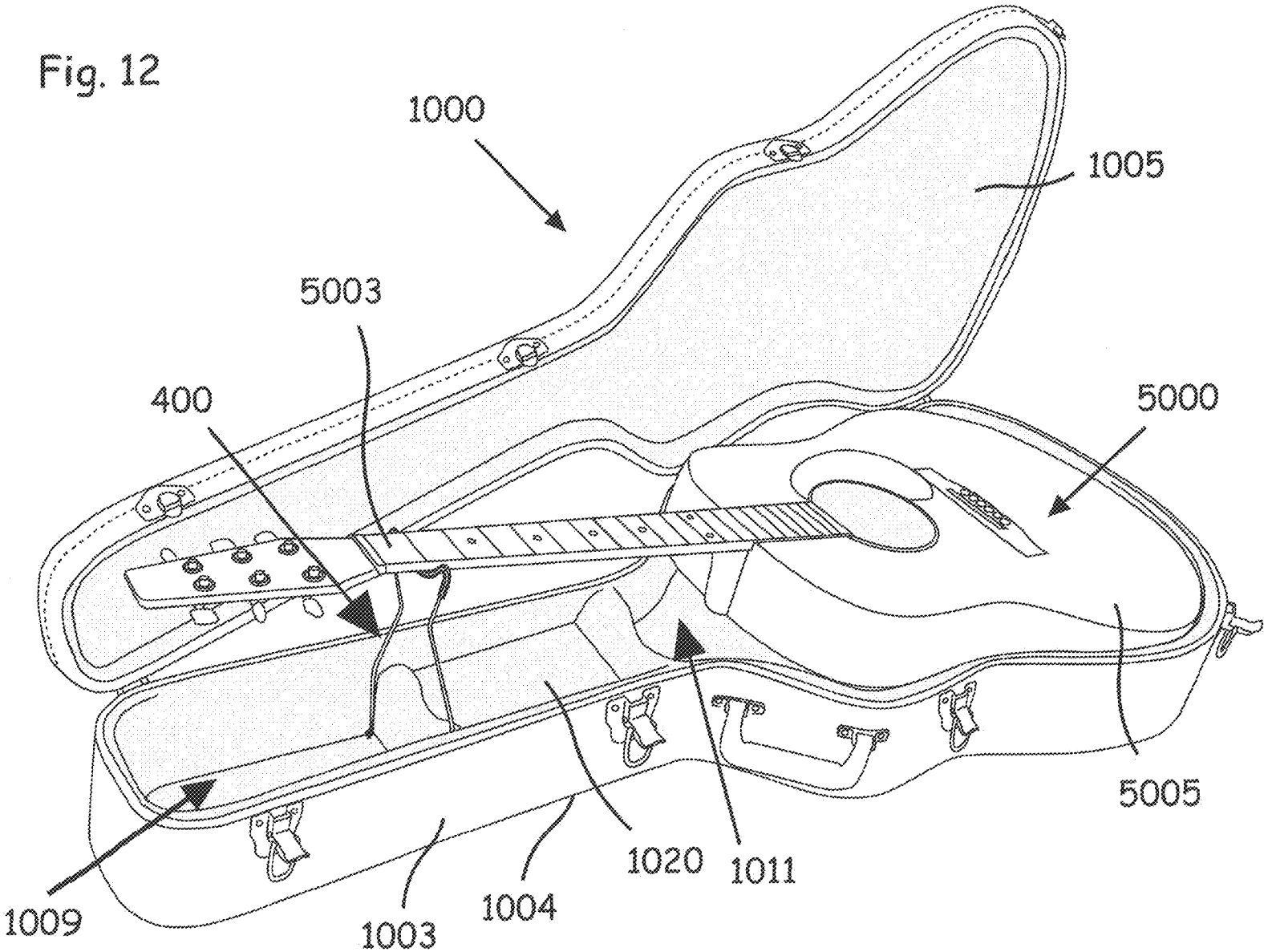
FIG. 12 is a perspective view an instrument case of FIG. 11 being opened and having an in-case stand in the upright position supporting a musical instrument in an inclined position.

FIG. 12 is a perspective view an instrument case of FIG. 11 being opened and having an in-case stand 400 in the upright position supporting a musical instrument 5000 in an inclined position for maintenance or other purposes.

Figure 13B:
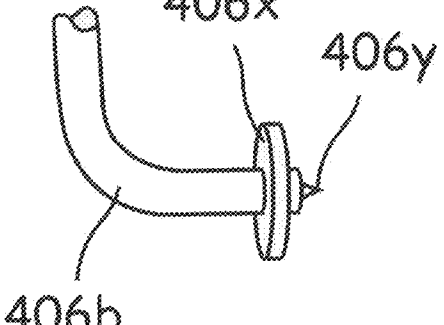
FIG. 13B is a front, elevational view of a base-support having an insertion-pin and washer for attachment of the in-case stand to the inside of the instrument case.
Figure 13D:
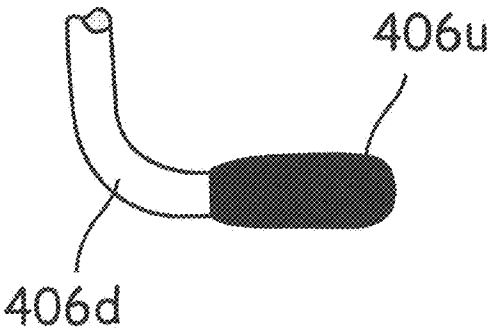
FIG. 13D is a front, elevational view of a base-support having a rubber-rounded-post for releasable attachment of the in-case stand to the inside of the instrument case.
Figure 13A:
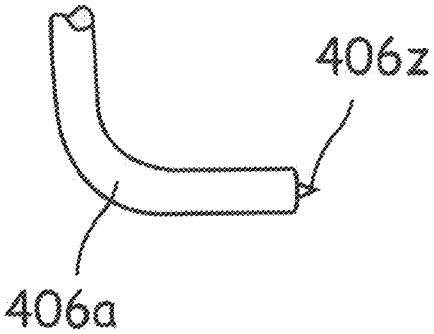
FIG. 13A is a front, elevational view of a base-support having an insertion-pin for attachment of the in-case stand to the inside of the instrument case.
Figure 13C:
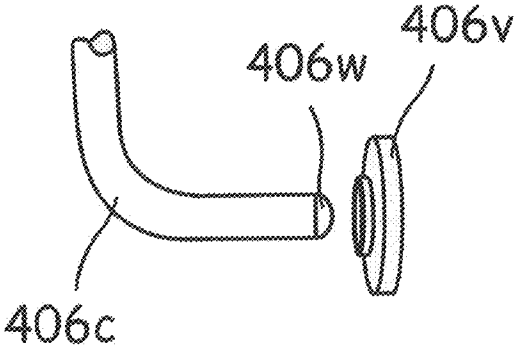
FIG. 13C is a front, elevational view of a base-support having a rounded-post and a recessed-washer for releasable attachment of the in-case stand to the inside of the instrument case.

FIG. 13A shows a front, elevational view of a base-support 406*a* having an insertion-pin 406*z* for attachment of the in-case stand to the inside of the instrument case. In another exemplary embodiment, FIG. 13B shows a front, elevational view of a base-support 406*b* having an insertion-pin 406*y* and washer 406*x* for attachment of the in-case stand to the inside of the instrument case. In another exemplary embodiment, FIG. 13C is a front, elevational view of a base-support 406*c* having a rounded-post 406*w* and a recessed-washer 406*v* for releasable attachment of the in-case stand to the inside of the instrument case. In another exemplary embodiment, FIG. 13D shows a front, elevational view of a base-support 406*d* having a rubber-rounded-post 406*u* for releasable attachment of the in-case stand to the inside of the instrument case.

Figure 13E:
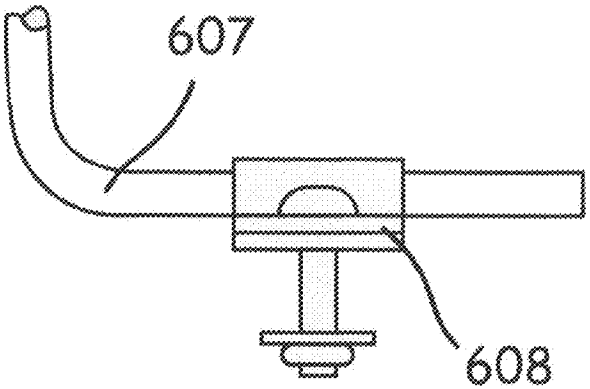
FIG. 13E is a front, elevational view of a base-support having a hinged-bracket for attachment of the in-case stand to the inside of the instrument case.
Figure 13G:
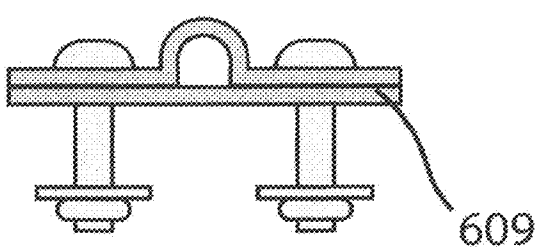
FIG. 13G is a side, elevational view of an alternative hinged-bracket.
Figure 13F:
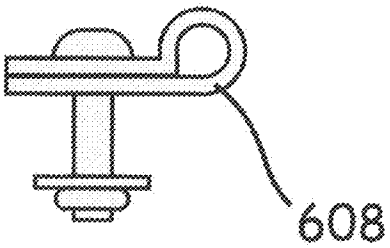
FIG. 13F is a side, elevational view of the hinged-bracket of FIG. 13E with the base-support being removed.

In another exemplary embodiment, FIG. 13E shows a front, elevational view of a base-support 607 having a hinged-bracket 608 for attachment of the in-case stand to the inside of the instrument case. In another exemplary embodiment, FIG. 13F shows a side, elevational view of the hinged-bracket 608 of FIG. 13E with the base-support 607 being removed. In another exemplary embodiment, FIG. 13G shows a side, elevational view of an alternative hinged-bracket 609.

Figures 14A, 14B, 14C:
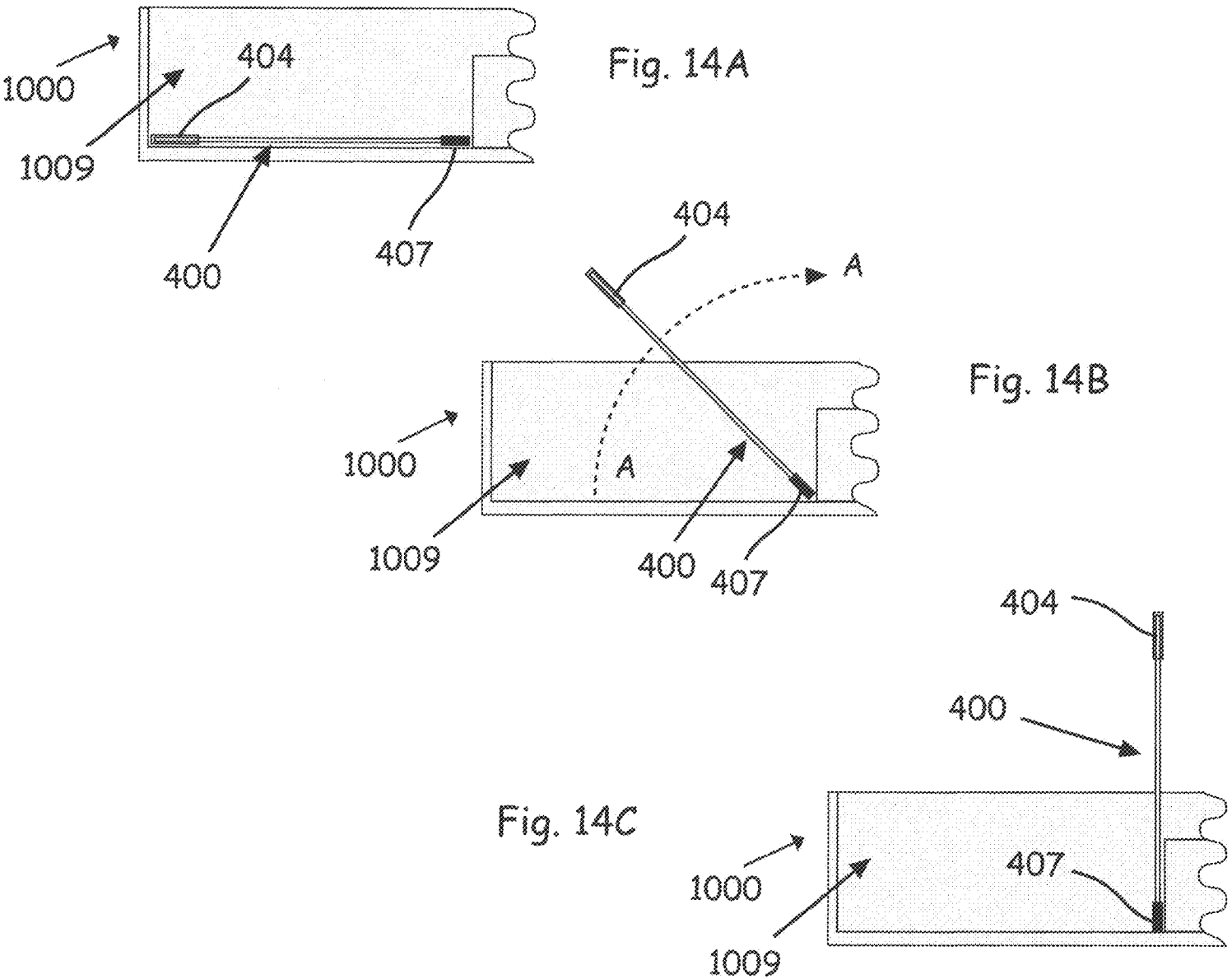
FIG. 14A is a cut-away side view of an open instrument case having an in-case stand being shown in the lay-down position to accommodate the storage of an instrument.
FIG. 14B is a cut-away side view of an open instrument case having an in-case stand being rotated along path A-A towards an upright position.
FIG. 14C is a cut-away side view of an open instrument case having an in-case stand being shown in the upright position to accommodate an inclined position of an instrument for light maintenance.

FIG. 14A shows a cut-away side view of an open instrument case 1000 having an in-case stand 400 being shown in the lay-down position to accommodate the storage of an instrument. FIG. 14B shows a cut-away side view of an open instrument 1000 case having an in-case stand 400 being rotated along path A-A towards an upright position. FIG. 14C is a cut-away side view of an open instrument case 1000 having an in-case stand 400 being shown in the upright position to accommodate an inclined position of an instrument for light maintenance.

Figure 15:
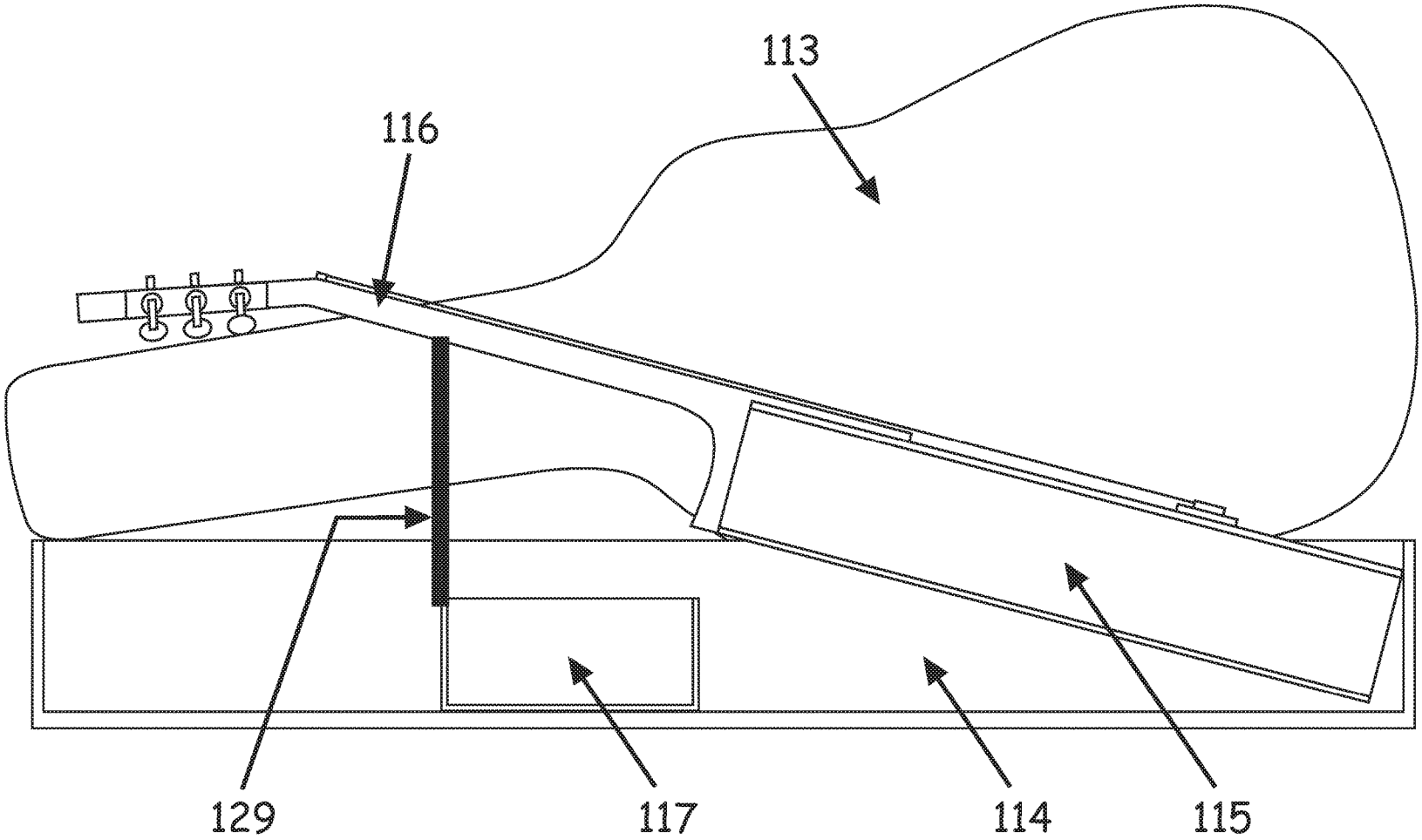
FIG. 15 depicts a cut-away, side view of an open instrument ease having an accessory-storage bin with a lid which also acts as an adjustable support.

FIG. 15 is a cut-away, side view of an instrument case 1000 having an accessory-storage bin 1020, said storage bin having a lid which also acts as the in-case stand 400. The storage bin lid acts as an adjustable support and has a cradle portion adapted to receive the top portion of the instrument, and has a base portion engaged and attached to the storage bin which is in turn attached to the inside of the instrument case. The instrument case 1000 being opened and having the storage lid/in-case stand 400 being in the upright position supporting a musical instrument 5000. The instrument case 1000 having a bottom surface 1004 for placement on the floor or other flat surfaces. Instrument case 1000 has a neck-storage area 1009 and a base-storage area 1011 with the accessory-storage bin 1020 positioned in-between. Musical instrument 5000, here depicted as a guitar having a guitar neck-portion 5003, guitar base-portion 5005 and musical strings 5007.

Figure 16:
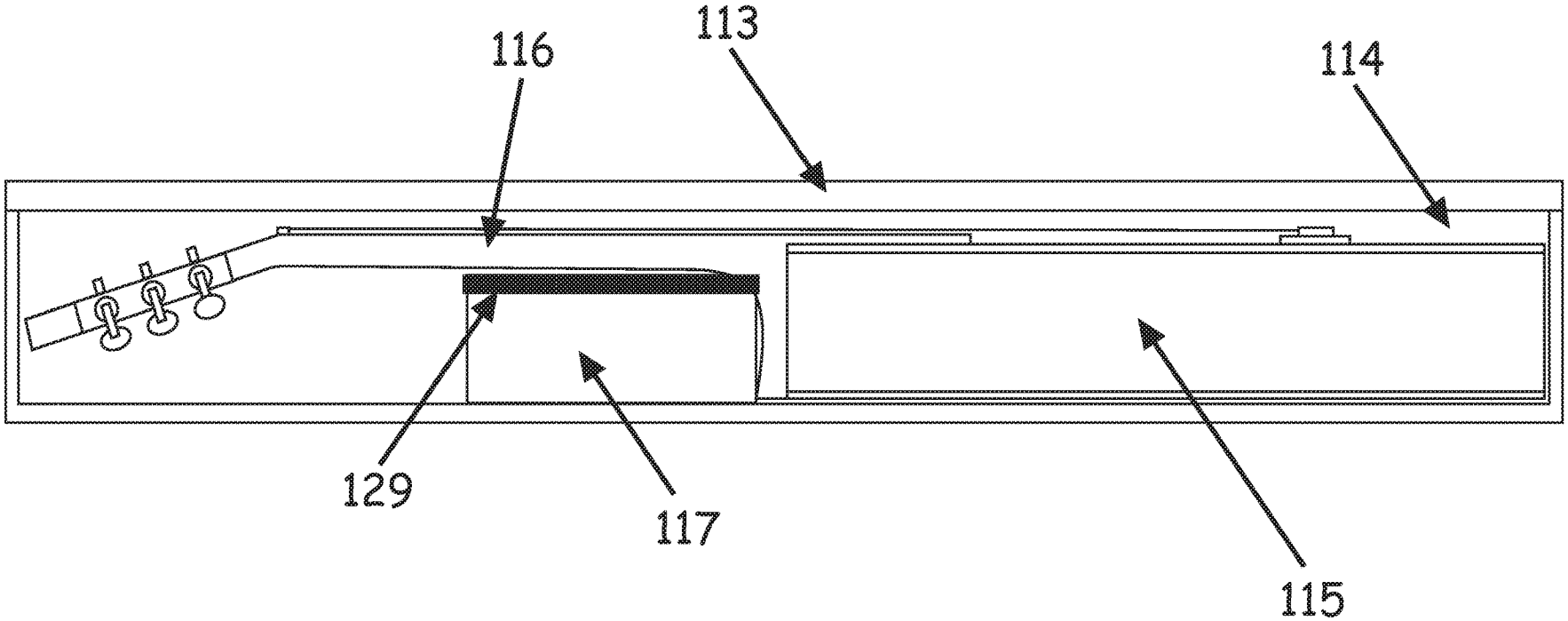
FIG. 16 depicts a cut-away, side view of a closed instrument case having an accessory-storage bin with a closed lid.

FIG. 16 is a cut-away, side view of instrument case 1000 of FIG. 15 being closed and having the storage bin lid/in-case stand 400 being in the closed and lay-down position underneath musical instrument 5000. In this view, it can be appreciated the simplicity and ease of how in-case stand 400 can be moved to the lay-down position for quick storage of musical instrument 5000.

Figure 17:
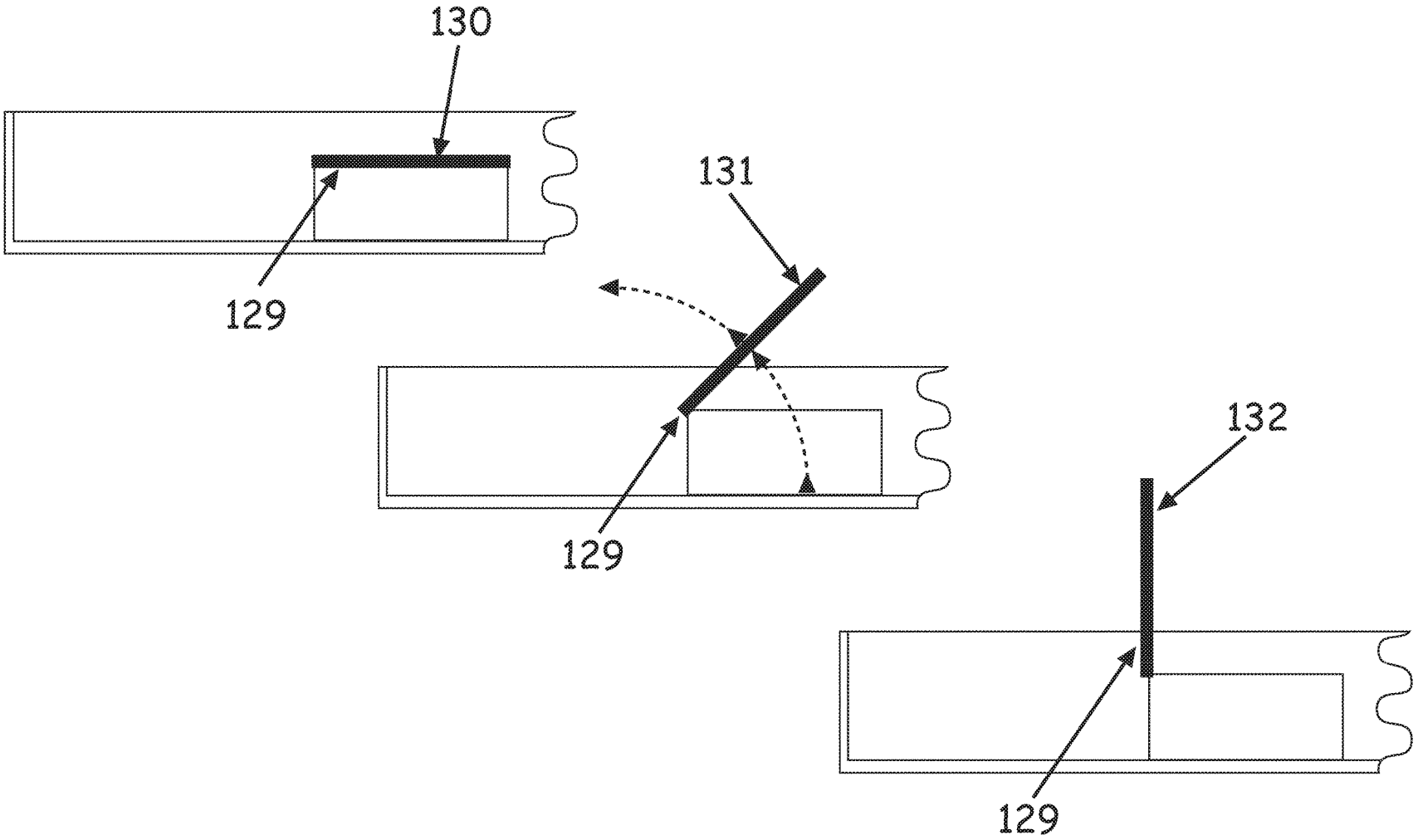
FIG. 17 depicts three cut-away side views of an accessory-storage bin of an instrument case where the respective views showing a closed lid on the accessory-storage bin, a lid rotating along path B-B towards an upright position, and an upright lid.

FIG. 17A shows a cut-away side view of an instrument case 1000 having an accessory-storage bin 1020, said storage bin having a lid which also acts as the in-case stand 400. The storage bin lid acts as an adjustable support and has a cradle portion adapted to receive the top portion of the instrument, and has a base portion engaged and attached to the storage bin which is in turn attached to the inside of the instrument case. having an in-case stand 400 being shown in the lay-down position to accommodate the storage of an instrument. FIG. 17B shows a cut-away side view of an open instrument 1000 case of FIG. 17A having a storage bin lid/in-case stand 400 being rotated along path B-B towards an upright position. FIG. 17C is a cut-away side view of an open instrument case 1000 of FIG. 17A having a storage bin lid/in-case stand 400 being shown in the upright position to accommodate an inclined position of an instrument for light maintenance.

One skilled in the art would appreciate that the present invention of the in-case stand and instrument case together may be adapted to hold a musical instrument on both its neck and base respectively. Additionally, the in-case stand and instrument case together may be adapted to hold a musical instrument substantially within the perimeter of the instrument case. In these configurations, the musical instrument is held securely and the instrument case is more stable than those cases shown in the prior art.

While particular embodiments of the present invention have been illustrated and described, it is contemplated in the present disclosure that various other changes and modifications can be made without departing from the spirit and scope of the invention. It is therefore intended to cover in the appended claims all such changes and modifications that are within the scope of this invention.

For example, the in-case stand may be adapted to store and upright-position for maintenance a variety of instruments including, but not limited to, an acoustic guitar, acoustic bass guitar, electric guitar, electric bass guitar, banjo, mandolin, viola, bass, violin and similar string musical instruments that are stored, transported and protected in a musical instrument case For example, the in-case stand may be constructed in a variety of designs and materials, including but not limited to poly-laminates, acrylic sheets, woods, wood composites, plastics and paperboards with flocked materials to serve the support and storage function within the musical instrument case. Additionally, the cradle portion may be constructed will be constructed of materials that cushion and support the musical instrument (e.g. acoustic guitar) neck without marring or scratching the material or finish.

For example, the adjustable support may be formed from a variety of materials including, but not limited to, wire rod, poly-laminate, acrylic sheet, wood, wood composites, plastics, metal, cardboard with flocked material and similar materials suitable for holding the headstock of a musical instrument.

For example, the cradle portion may be fully or partially encapsulated in a damping material such as rubber, nylon, vinyl, plastic, felt material or the like.

For example, once in the upright position the adjustable support can be held in place by systems typically known in the industry. For example, a paired magnet system could be used where one magnet is attached to the body portion of the adjustable support and a second magnet is attached to a surface perpendicular to the bottom of the case such as the wall of the accessory storage bin. In another example, the upright adjustable support is held in place with paired clasps or clips where clips are attached to each of the body portion and the perpendicular support and connected when the adjustable support is raised.

For example, the adjustable support of the in case stand is raised and lowered by with mechanical automation. A motor is installed in the case. The motor in-turn rotates the adjustable support from its resting position to the upright position. Alternatively, the motor actuates a robotic arm the pushes the support into its upright position. The motor can be selected from motors know in the industry, such as servomotors. The motorized system comprises a source of power. For example, the case may comprise a rechargeable battery to power the motor and or the robotic arm to move the adjustable support to its upright position.

What is claimed is:

1. An in-case stand for holding a musical instrument within an instrument case, said in-case stand comprising:

an adjustable support having sufficient rigidity for holding and inclining a musical instrument;

said adjustable support comprising:

i) a cradle portion being adapted to receive the top portion of an instrument;

ii) a body portion being of sufficient length and rigidity to permit the proper angle and height of the instrument when in-case is in the upright position; and iii) a base portion being adapted to engage and attach said in-case stand to the inside of the instrument case and comprising a releasable attachment comprising a rubber-rounded to accommodate the releasable attachment of said in-case stand to the inside of an instrument case.

2. An in-case stand for holding a musical instrument within an instrument case, said in-case stand comprising:

an adjustable support having sufficient rigidity for holding and inclining a musical instrument;

said adjustable support comprising:

i) a cradle portion being adapted to receive the top portion of an instrument;

ii) a body portion being of sufficient length and rigidity to permit the proper angle and height of the instrument when in-case is in the upright position; and iii) a base portion being adapted to engage and attach said in-case stand to the inside of the instrument case; and a permanent hinge to accommodate the permanent attachment of said in-case stand to the inside of an instrument case.

3. An in-case stand for holding a musical instrument within an instrument case, said in-case stand comprising:

an adjustable support having sufficient rigidity for holding and inclining a musical instrument;

said adjustable support comprising:

i) a cradle portion being adapted to receive the top portion of an instrument;

ii) a body portion being of sufficient length and rigidity to permit the proper angle and height of the instrument when in-case is in the upright position; and iii) a base portion being adapted to engage and attach said in-case stand to the inside of the instrument case; and wherein the body portion further comprises a relief cutout to reduce the amount of material and weight of adjustable support to ultimately reduce the weight of the instrument case making it easier for the musician to carry it.

* * * * *